United States Patent [19]

Fortier et al.

[11] 4,325,300

[45] Apr. 20, 1982

[54] DIE CLAMP ARRANGEMENT

[75] Inventors: Joseph R. Fortier, New Baltimore; John L. Klett, Howell, both of Mich.

[73] Assignee: General Motors Corporation, Detroit, Mich.

[21] Appl. No.: 206,554

[22] Filed: Nov. 13, 1980

[51] Int. Cl.[3] ..... B30B 15/06

[52] U.S. Cl. ..... 100/295; 24/263 B; 83/698; 100/918; 403/321

[58] Field of Search ..... 100/295, 918; 403/321; 24/263 B, 81 WH; 72/462; 83/698

[56] References Cited

U.S. PATENT DOCUMENTS

| | | | |
|---|---|---|---|
| 881,665 | 3/1908 | Corcoran . | |
| 1,016,353 | 2/1912 | Morgan . | |
| 1,692,913 | 11/1928 | Whiting . | |
| 2,121,450 | 6/1938 | Sentrop | 25/41 |
| 2,984,176 | 5/1961 | Sommer | 83/698 |
| 2,984,880 | 5/1961 | Danly | 24/81 WH |
| 3,027,793 | 4/1962 | Sommer | 83/698 |
| 3,111,100 | 11/1963 | Georgeff | 100/DIG. 18 |
| 3,229,791 | 1/1966 | Soman | 403/321 |
| 3,348,802 | 10/1967 | Corbett | 249/163 |

*Primary Examiner*—Billy J. Wilhite
*Attorney, Agent, or Firm*—Patrick R. Griffin

[57] ABSTRACT

A die clamp arrangement for attaching a die member to a press slide includes an elongated attachment member rotatably and slidably attached near its upper end in guide slots of a support bracket attached to a vertical face of the press slide. In attachment position, the lower threaded end of the attachment member extends below the press slide. A pin on the attachment member rests on the press slide and a square shaped intermediate section of the attachment member is located in a like shaped slot in the press slide to thereby distribute to the press slide the compressive clamping and torque loads which result from a nut being threaded on the attachment member to secure the die member to the press slide. In a self-stored position, the elongated member is moved relative to the guide slots to engage the upper end thereof with the support bracket under the force of gravity and maintain the lower end of the attachment member free of the area below the press slide.

3 Claims, 5 Drawing Figures

DIE CLAMP ARRANGEMENT

BACKGROUND OF THE INVENTION

This invention relates generally to clamping arrangements for fastening die members to press slides, more specifically, to a die clamp arrangement mounted on the press slide for movement between an attachment position for clamping the die member to the press slide and a self-stored position for maintaining the clamp arrangement free of the underside of the press slide facilitating the removal and change of the die member.

DESCRIPTION OF THE PRIOR ART

Die members are conventionally attached to press slides by bolt arrangements. In one such arrangement, hex headed bolts pass through holes in the press slide and extend below the lower side of the press slide where they pass through U-slots in the die member, which is attached to the bolts by nuts threaded thereon. In another arrangement, T-bolts are slidably received in T-shaped slots in the lower side of the press slide and extend below the press slide for attachment to the die member as described. Both arrangements require the complete removal of the attachment bolts from the press slide in order to free the area beneath the press slide from obstructions during removal and change of the die member.

SUMMARY OF THE INVENTION

The die clamp arrangement of the present invention is mounted on the press slide and movable between an attachment position where it depends from the press slide to conventionally attach a die member to the press slide, and a self-stored position where the force of gravity maintains it free from the area beneath the press slide. In addition, the preferred embodiment includes means for applying the compressive clamping load and the torque load to the press slide and isolating the clamping arrangement from those loads.

In the preferred embodiment disclosed, the die clamp arrangement is attached to the press by a U-shaped support bracket joined to a vertical face of the upper press slide. A clevis extending outwardly from the support bracket has a pair of aligned slots therein angled upwardly and outwardly from the press slide. A die attachment member has a guide pin rigidly attached near its upper end and transversely thereto which is also rotatably and slidably contained in the guide slots of the clevis. In the attachment position, the die attachment member hangs from the support bracket substantially parallel to the vertical face of the press slide with its lower end, which is threaded, extending below the press slide and also through U-shaped slots in a die member. Clamping and compressive loads resulting from the attachment of the die member to the attachment member by a nut threaded thereon are isolated from the support bracket by two additional features of the attachment member. First, the attachment member has a rectangular intermediate portion which, in the attachment position, is contained within an open, like-shaped slot in the press slide. Because of this close fit, torque loads induced on the attachment member are transferred to the press slide and isolated from the support bracket. In addition, a load distributing member or pin included on the attachment member intermediate the rectangular portion and the guide pin rests, when the attachment member is in the attachment position, on a horizontal surface of the press slide such that the guide pin is maintained slightly above the lower end of the pair of aligned guide slots. Thus, as the attachment nut is tightened, compressive loads are distributed from the attachment member through the load distributing pin to the press slide and are thereby isolated from the support bracket. Thus, the support bracket may be made of a fairly light material. In addition, these load distributing and isolating functions of the attachment member do not interfere with the self-storage function of the die clamp arrangement, as will be described.

In order to remove or change a die member, the die member is first conventionally supported independently from the attachment member by blocks or other suitable means. The attachment nut is moved from the threaded lower end of the attachment member and the attachment member is rotated up approximately 180°. Simultaneously with this upward rotation, the attachment member is pulled slightly outwardly from the vertical face of the press slide so that the guide pin rotates and slides away from the lower end of the guide slots to a position where the upper end of the die attachment member will clear the base of the support bracket as the attachment member is rotated upwardly. Next, the die attachment member is moved slightly downwardly toward the vertical face of the press slide with the guide pin moving simultaneously toward the lower end of the guide slots. When the upper end of the die attachment member engages the base of the support bracket, the attachment member is effectively wedged between the base of the support bracket and the guide pin in the guide slot under the force of gravity which acts on the attachment member to tend to rotate it back toward the attachment position. Thus, the force of gravity maintains the attachment member in this self-stored position with its lower threaded end free of the lower surface of the guide member so that the die member may be easily removed and another moved into place. When the attachment member is again pulled slightly upwardly and outwardly from the vertical face and the guide pin again moved up the slots to a position where the upper end of the attachment clears the base of the support bracket, the attachment member may be again rotated back to its attachment position and another die member attached thereto as before. It will be understood that as the die attachment member is swung back down to the attachment position the rectangular intermediate portion passes into the like shaped slot and the load distribution pin rests against the horizontal face of the press slide without any additional action by the operator.

The invention provides, therefore, a die clamping arrangement wherein an attachment member is movable between an attachment position with its lower threaded end hanging beneath the lower side of the press slide and a self-stored position with the threaded lower end removed from beneath the press slide for the attachment of a new die member, without the necessity of removing the die attachment member from the press slide. In addition, compressive and torque loads on the attachment member are distributed over the press slide, such load distributing action occurring without additional action by the operator.

BRIEF DESCRIPTION OF THE DRAWINGS

These and other objects of the invention will appear from the following specification and drawing wherein.

DESCRIPTION OF THE PREFERRED EMBODIMENT

Figure 1:
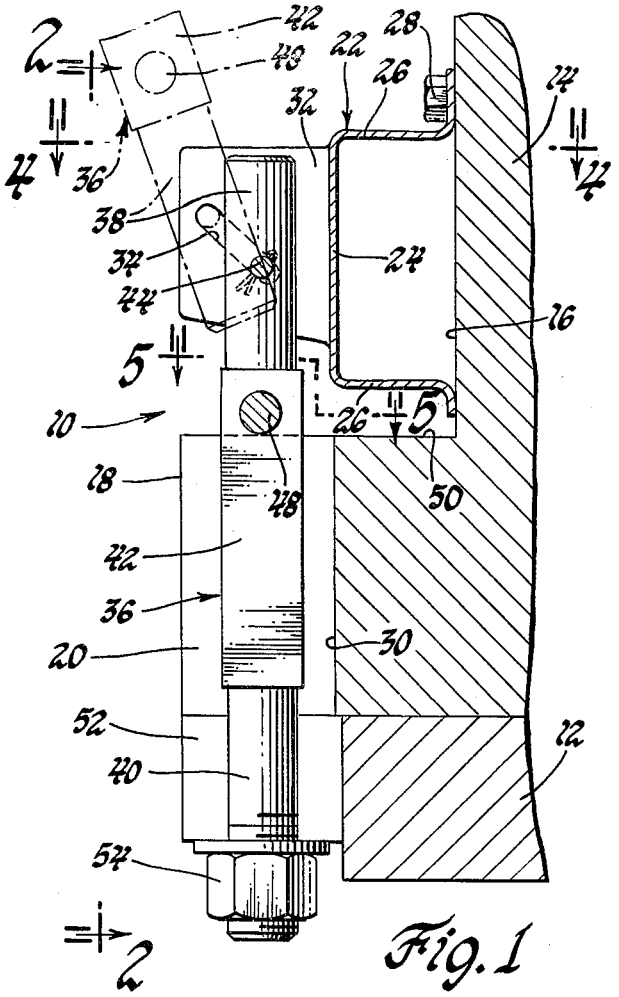
FIG. 1 is a sectional view of a portion of a conventional press slide and die member attached thereto by a die clamp arrangement according to this invention, with the die clamp arrangement shown in attachment position.
Figure 2:
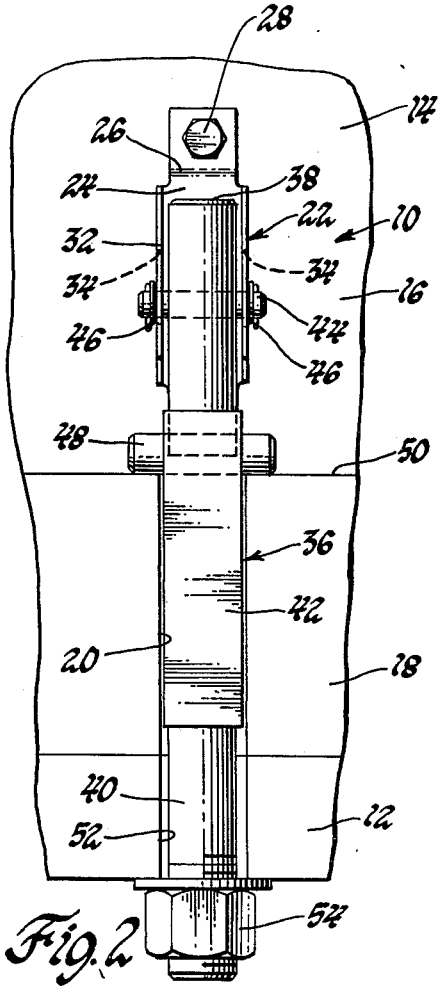
FIG. 2 is a view taken generally along the plane indicated by line 2—2 in FIG. 1.

Referring to FIGS. 1 and 2 the die clamp arrangement of the present invention is designated generally 10 and is shown attaching an upper die member 12 to press slide 14. Press slide 14 includes an upper vertical face 16 and a lower vertical face 18 which includes a vertically directed, open, channel shaped slot 20. A support bracket 22 includes a base 24 having a pair of integral flanged legs 26 extending laterally therefrom and seating on the upper vertical face 16 of the press slide. A bolt 28 secures one leg 26 to the press slide to mount the bracket 22 thereon. The base 24 is approximately aligned with the base wall 30 of the slot 20. Support bracket 22 further includes a clevis 32, the legs of which extend outwardly approximately as far as the vertical face 18. Each leg of the clevis contains an aligned closed guide slot 34 which slopes upwardly and outwardly from the press slide 14 at approximately a 45° angle.

Figure 4:
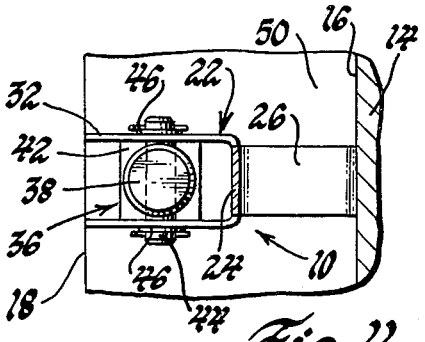
FIG. 4 is a sectional view taken along the plane indicated by line 4—4 of FIG. 1.
Figure 5:
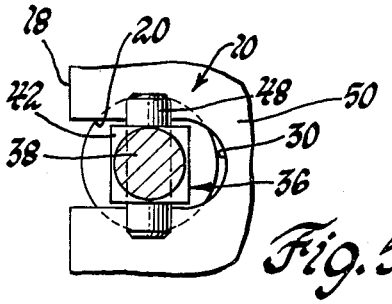
FIG. 5 is a sectional view taken along the plane indicated by line 5—5 of FIG. 1.

A bolt or attachment member 36 has a cylindrical upper end 38, a cylindrical lower threaded end 40, and a generally rectangular shaped intermediate portion 42. A guide pin 44 extends through a bore in the upper cylindrical end 38 and also through each guide slot 34 in the legs of the clevis 32 to pivotally and slidably mount the attachment member to the support bracket 22. The pin 44 is held against withdrawal by conventional cotter key and washer assemblies 46, FIG. 4. A load distributing member or pin 48 is tightly contained in a bore through the intermediate portion 42. When the attachment member is in the attachment position shown in full lines in FIG. 1 and also in FIG. 2, the pin 48 seats on a horizontal upper surface 50 of the press slide across the upper end of the slot 20 to thereby locate the guide pin 44 slightly spaced from the lower closed ends of slots 34. The intermediate portion 42 of the attachment member is non-rotatably received in slot 20, and the lower threaded end 40 is conventionally received in a U-shaped slot 52 of the die member 12. The die member 12 is attached to the attachment member 36 by a nut 54 threaded on the lower end 40 of the attachment member. When the nut 54 is tightened against the die member 12, the compressive clamping load is distributed to the press slide 14 by the nut and the load distributing pin 48. The torque load is also distributed to the press slide by the intermediate portion 42 of the attachment member 36 and the slot 20. Thus, none of the clamping and torque loads is placed on the bracket 22 and this bracket can, therefore, be of light weight structure. Also, neither of the loads acts to distort or bend the bracket.

It will be understood that a number of clamp arrangements 10 are mounted on various upper vertical faces of the press slide for supporting the die member 12. Only one such clamp arrangement has been shown and described and the others will be of like construction.

Figure 3:
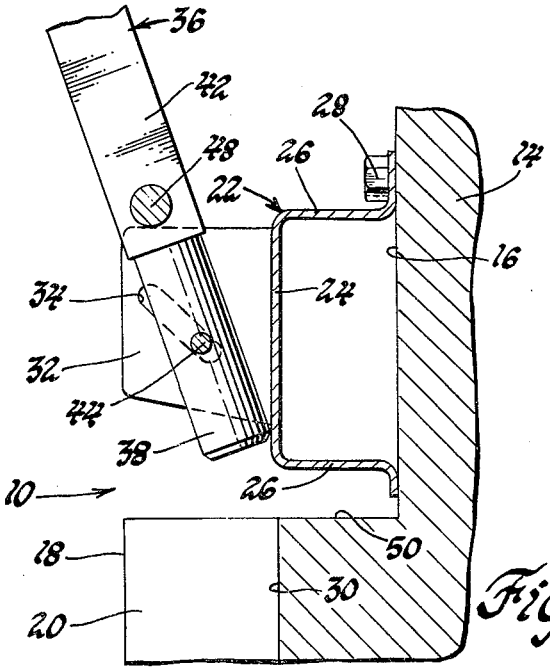
FIG. 3 is a partial view similar to FIG. 1 showing the die clamp arrangement in self-stored position.

When it is desired to remove or replace the die member 12, the die member is either rested against the lower die member, not shown, by lowering the press slide or supported by wooden blocks or other support means in a conventional fashion. The attachment nut 54 is then removed. The attachment member 36 is then swung upwardly through an arc of approximately 180° and also moved outwardly of the press slide so that the upper end 38 of the attachment member can move past the base 24 of the bracket 22 from its position shown in full lines in FIG. 1 to its position shown in dash lines therein. Thereafter the attachment member is slightly moved downwardly and along the slots 34 to engage the upper end 38 thereof with the base 24 of the bracket 22 as shown in FIG. 3 to locate and maintain the attachment member 36 in its self-stored position. In this position, the force of gravity maintains the upper end 38 in engagement with the base 24 as long as desired. It will be noted that the attachment member 36 is free of the lower side of the press slide so that the die member 12 can be removed and changed at will without any interference from the attachment member.

After the die member 12 has been removed and changed, the subsequent die member can be attached to the press slide 14 by first moving the attachment member 36 slightly upwardly and outwardly of the press slide so that the upper end 38 can move past the base 24 of the support bracket 22 during a subsequent pivoting of the attachment member to the attachment position shown in FIG. 1. Thereafter, the nut 54 attaches the die member 12 to the press slide as previously described. During the movement of the attachment member between its attachment and self-stored positions, the guide pin 44 both pivots and slides in the guide slots 34 of the legs of the clevis. Furthermore, during the movement of attachment member 36 back to attachment position, pin 48 engages horizontal surface 50 and rectangular portion 42 moves into slot 30 automatically.

As previously mentioned, a number of die clamp arrangements would be mounted on the upper vertical face 16 of the press slide. The number depends, of course, on the weight of the die member 12, although the number necessary to support a particular die member 12 may be less than the total number mounted on the press slide.

Thus this invention provides a die clamp arrangement which is easily and quickly movable between an attachment position wherein the arrangement is operative to clamp a die member to a press slide and a self-stored position wherein the die clamp arrangement is free of the lower side of the press slide to facilitate removal and change of the die member. In addition, torque and compressive load on the attachment member are distributed to the press slide and isolated from the mounting arrangement by load distributing members which act cooperatively with the press slide without additional action by the operator.

The embodiments of the invention in which an exclusive property or privilege is claimed are defined as follows:

1. In combination with a press slide having a lower horizontal face, an upper horizontal face and a vertical face, a die clamp arrangement for securing a die member beneath the lower horizontal face, comprising, an elongated die attachment member having an upper end, a lower threaded end, and an intermediate portion, means pivotally and slidably mounting the die attachment member to the press slide for movement between an attachment position wherein the die member hangs vertically with respect to the press slide with the lower threaded end beneath the lower horizontal face of the press slide for securing a die member thereto, and a self-stored position wherein the die attachment member is maintained in a position extending up and away from the vertical face of the press slide and free of the space beneath the lower horizontal face of the press slide to allow removal of the die member, torque load distribution means cooperating between the intermediate portion of the die attachment member and the press slide to maintain the die attachment member non-rotatably and releasably with respect to the press slide and to distribute the torque loads resulting from attachment of the die member to the press slide, compressive load distribution means cooperating between the die attachment member and the upper horizontal face of the press slide to distribute to the press slide compressive loads on the die attachment member occurring from attachment of the die member thereto, the torque and compressive load distributing means acting in cooperation with the press slide upon movement of the die attachment member into the attachment position such that said means become operative without additional action by the operator.

2. A die clamp arrangment for securing a die member to a lower horizontal face of a press slide having an upper horizontal face and a vertical face, comprising, an elongated die attachment member having an upper end, an intermediate portion, and a lower threaded end, means pivotally and slidably mounting the die attachment member adjacent the upper end thereof to the press slide for movement between an attachment position wherein the die attachment member hangs vertically with respect to the press slide with the lower threaded end thereof depending from the lower horizontal face of the press slide for securing a die member to the press slide, and a self-stored position wherein the die attachment member extends angularly to the press slide and is free of the lower horizontal face of the press slide to facilitate removal and change of the die member, cooperating means on the die attachment member and the vertical face of the press slide for non-rotatably releasably securing the intermediate portion of the die attachment member to the press slide when the die attachment member is in the attachment position, engaging means on the die attachment member engageable with the upper horizontal face of the press slide in the attachment position, whereby a nut threaded on the lower threaded end of the die attachment member clamps the die member to the press slide between the engaging means and the nut to ensure that all compressive loads are applied to the press slide and die member, the cooperating means on the die attachment member and press slide ensuring that all torque loads applied by the nut to the attachment member are applied to the press slide, and cooperating means on the upper end of the die attachment member and the mounting means for releasably holding the die attachment member in the self-stored position.

3. A die clamp arrangement for securing a die member to a lower horizontal face of a press slide which includes an upper horizontal face and a vertical face comprising, an elongated die attachment member having an upper end, an intermediate portion, and a lower threaded end, a support bracket attached to the vertical face of the press slide and having a guide slot defined therein which slopes upwardly and away from the vertical face of the press slide, the die attachment member further including a guide pin adjacent the upper end thereof rotatably and slidably contained in the guide slot whereby the attachment member hangs in an attachment position vertically with respect to the press slide with the lower threaded end beneath the lower face of the press slide, the guide pin being movable up the guide slot such that the attachment member may be simultaneously rotated upwardly and moved away from the vertical face of the press slide to a position wherein the upper end of the attachment member rotates free of the support bracket, said upper end being wedgeable between the vertical face and guide slot as the guide pin moves back down the slot slightly and the attachment member is simultaneously moved toward the vertical face of the press slide and is acted on by the force of gravity, the force of gravity and wedging action serving to maintain the attachment member in a self-stored position with the lower threaded end free from the lower horizontal face of the press slide to facilitate removal of a die member, the press slide further having a vertically directed, open slot with an inside configuration matching the outside configuration of the intermediate portion of the attachment member whereby the attachment member is non-rotatably and releasably contained therein in the attachment position so that torque load induced on the attachment member by the attachment of a die member thereto is distributed to the press slide and isolated from the support bracket, the die attachment member further including a load distributing pin attached transverse thereto between its upper end and the intermediate portion such that the load distributing pin is engaged with the upper horizontal face of the press slide when the attachment member is in the attachment position, said load distributing pin engaging the upper horizontal face when the die attachment member is moved to the attachment position from the self-stored position and serving to distribute the compressive load across the press slide when a die member is attached thereto by a nut on the lower threaded end of the attachment member.

* * * * *